US006253456B1

(12) United States Patent
Cooksey

(10) Patent No.: US 6,253,456 B1
(45) Date of Patent: Jul. 3, 2001

(54) BASKETBALL COURT LAYOUT DEVICE AND METHOD

(76) Inventor: Phillip Cooksey, 352 N. Sunnyside Ave., Fresno, CA (US) 93727

( * ) Notice: Subject to any disclaimer, the term of this patent is extended or adjusted under 35 U.S.C. 154(b) by 0 days.

(21) Appl. No.: 08/972,087

(22) Filed: Nov. 17, 1997

(51) Int. Cl.[7] ..... G01B 3/00; G01B 3/10; A63C 19/06

(52) U.S. Cl. ..... 33/1 G; 33/27.01; 33/756; 33/759; 473/490

(58) Field of Search ..... 33/1 G, 27.01, 33/27.02, 27.03, 484, 490, 494, 755, 756, 759, 760; 473/415, 468, 470, 472, 490

(56) References Cited

U.S. PATENT DOCUMENTS

| | | | | |
|---|---|---|---|---|
| D. 361,667 | | 8/1995 | Brown | D4/122 |
| 464,205 | * | 12/1891 | Swope | 33/756 |
| 3,039,197 | * | 6/1962 | Abbott | 33/755 |
| 3,834,030 | * | 9/1974 | Hanson | 33/759 |
| 3,889,379 | | 6/1975 | Cline | 33/562 |
| 4,160,324 | * | 7/1979 | Dunn | 33/759 |
| 4,510,692 | | 4/1985 | Overholser | 33/562 |
| 4,937,949 | | 7/1990 | Kiefer | 33/1 G |
| 5,253,421 | * | 10/1993 | Landmark | 33/760 |
| 5,280,921 | * | 1/1994 | Milburn | 33/759 |
| 5,371,949 | * | 12/1994 | Delaurier | 33/562 |
| 5,427,383 | * | 6/1995 | Viens | 33/759 |
| 5,519,940 | * | 5/1996 | Brondfield | 33/1 G |
| 5,800,297 | * | 9/1998 | Aldstadt | 473/490 |
| 5,928,095 | * | 7/1999 | Aldstadt | 473/490 |

* cited by examiner

*Primary Examiner*—G. Bradley Bennett
(74) *Attorney, Agent, or Firm*—Richard A. Ryan

(57) ABSTRACT

A device and method to quickly and easily layout various features of a basketball court, including the key area, free throw line, jump circle and three point line, in relation to the location of the backboard, including two cord-like members interconnected by a ring-like member having additional ring-like members at each end of the cord-like members. The cord-like members are flexible, facilitating easy transport and storage of the device, and inextensible. The various ring-like members can be colored or otherwise made to be distinguishable from each other to simplify the process of laying out the various basketball court features. A pivot tool is also provided to facilitate the user's use of the device. Additional cord-like and ring-like members can be provided to assist locating and designating the end and side lines.

19 Claims, 5 Drawing Sheets

BASKETBALL COURT LAYOUT DEVICE AND METHOD

BACKGROUND OF THE INVENTION

1. Field of the Invention

The field of the present invention relates generally to devices and methods for quickly and easily setting up a field or court to be used for athletic play. More particularly, the present invention relates to devices and methods for quickly and easily laying out a basketball court. Even more particularly, the present invention relates to devices and methods that assist the user in properly placing the various lines and curves that comprise a basketball court.

2. Background

It is generally well known that many people participate in sports activities at locations other than those that are specifically designated and marked for that sport. For instance, many people like to play basketball on the street or pavement near their home or work location. Naturally, these locations usually do not have the markings for the basketball court on the playing surface. Even many locations that have basketball courts, such as school yards and parks, do not have the court layout marked on the playing surface.

As with many court sports, basketball has many rules and requirements for the court that are specific to that sport. The primary components of a basketball court are well known. In addition to the outer boundaries of the court and the basketball pole, backboard, rim and net, an official basketball court has a number of locations laid out on the surface that are important aspects of the game. The designated lines and areas that are utilized in a basketball court have specific dimensional proportions and relationships. To facilitate the reader's understanding of the inventor's invention, the following discussion includes a brief summary of the layout of a basketball court.

Basketball is typically played on a rectangular shaped court. The out-of-bounds lines are the sidelines along the longer edges of the court and the end lines along the shorter edge of the court. The basketball poles, which are used when the backboard is not hung from the ceiling, are located at the center of each end line outside the boundaries of the court. The end line is typically located four feet behind the intersection of the horizontal plane of the playing surface with an imaginary vertical plane along the face of the backboard (for purposes of this disclosure, this line is referred to as the base line). The relative location of the pole to the end line, i.e., the amount the pole is set outside the court, is dependant upon the length of the backboard mounting structure. In some cases, this offset amount is less than four feet, resulting in the end line being less than four feet behind the base line or equal to the base line. The end line extends an equal distance from the center of the basketball net or pole. The entire length of the end line can vary, for a regulation basketball court, from forty-two to fifty feet. The side lines can vary from seventy-four to ninety-four feet in length.

The basketball net hangs over the court from the circular ring portion of the rim. The rectangular shaped area immediately below the net is designated the "key." The boundaries of the key consists of a portion of the end line, two lines extending an equal distance perpendicularly from the end line, and a line parallel to the end line that connects the ends of the two lines extending perpendicularly from the end line. The line at the top of the key, the side furthest from the end line, is known as the free throw line. The free throw line is used when a player is awarded an unopposed shot at the net due to a foul by a player on the opposing team or due to an accumulation of fouls by the opposing team. The mid-point of the free throw line is the center of a circular ring, such that the free throw line extends along the entire diameter of the ring. The circular ring is used for a jump ball, which is a ball thrown up by the referee between two players located in the center of the ring (the players attempt to pass or knock the ball towards their teammates located outside the ring). Outside the key area is a semi-circular arch that is used for distance shots. This arch is designated the three point line because balls shot from outside the arch which go through the net are awarded three points instead of the usual two points (or one point for free throw shots). The three point line extends from the end line on one side of the pole to the end line on the other side of the pole such that the center of the arch intersects the top of the circular ring at the point furthest from the end line.

Through discussions and participation with persons who enjoy playing basketball, the inventor has found that most players prefer to play on a surface that has the various court components described above properly laid out. Reasons for wanting the proper layout, or as near the proper layout as possible, include the desire to play the game correctly, to further improvement and to avoid developing poor techniques. When the basketball court is not laid out, the players are forced to estimate the location of many of the components of an official basketball court. Naturally, this results in courts that are not regulation or which lack some of the required components.

The current procedure for laying out a basketball court involves the use of measurement devices, such as tape measures and rulers, to place the various court components in relation to the basket ball pole and backboard. For official basketball courts this is usually not a problem as the court is placed down in a permanent or virtually permanent manner. For the basketball player who does not have access to a permanently laid out court, the difficult and time consuming process of properly laying out the basketball court is usually not done. As an example, the player who utilizes a portable basketball goal to practice in the street or driveway will usually not bother with the proper court layout if it takes him or her too long to set it up. Many of the players who do not have regular access to a properly laid out basketball court participate in leagues, such as school, church or similar organized sports, where practice on a proper court would improve their basketball skills. A easily transportable device and method for simply and quickly laying out the various features of a basketball court is needed to assist these players.

SUMMARY OF THE INVENTION

The basketball court layout device and method of the present invention provides a transportable device and method for easily and quickly laying out the various features of a basketball court. In its preferred embodiment, the present invention is comprised of two flexible, inextensible members made of a cord-like material, such as cord, rope, wire and the like. Connected to and interconnecting these cord-like members are a series of ring-like members that are spaced so as to facilitate the layout of various basketball court configurations, typically dependant on the age and level of play.

In the preferred embodiment, a first ring is connected to one end of the first cord member and a second ring is connected to the opposite end. One end of a second cord member is also connected to the second ring. The opposite end of the second cord member is connected to a third ring. A fourth ring is connected to the first cord member between the first and second rings. The rings should connect to the first and second cord members in a way that permits one end of the cord to slide along the ring when the other end of the cord pivots around the stationary ring.

The distance between the rings is determined by the dimensions of the court for which the device of the present invention is designed. For instance, a regulation court has a key that is twelve feet wide (which is the width of the free throw line) and fifteen feet long, as measured from the plane of the backboard (the base line), or nineteen feet long from the regulation end line. The jump circle has a six foot radius (diameter of twelve feet). Other, non-regulation courts may have measurements that differ from the above.

For the regulation court, the distance from the center of the first ring to the center of the second ring should be fifteen feet. The distance from the center of the second ring to the center of the third ring should be six feet, giving a combined first cord member and second cord member length of twenty-one feet. The distance from the first ring to the fourth ring should be six feet.

Using the measurements of the preferred embodiment described above, a basketball court having a regulation key, free throw line, jump circle and three point line can be laid out on any surface suitable for playing basketball on. The user of the device first locates the starting point, which is a point directly below the center of the backboard face. The first ring is held in place on the starting point and a marking device, such as a stick of chalk, is placed into the third ring. The first and second cord members are pulled tight, extending to the full twenty-one foot length, and the marking device is placed on a point to one side of the basket along the plane of the backboard. Holding tension on the cord members, the user draws a semicircular arch that extends from one side of the basket to the backboard plane on the other side. This arch is the three point line.

From the starting point, and with the marking device still in the third ring, the user pulls the cord members tight in a direction perpendicular to the backboard plane and locates the top of the arch, which is a point furthest from the backboard. The user then holds the second ring in place and, with the marking device still in the third ring, draws a circle having the second ring at its center. This circle is the jump circle.

To layout the key, the user holds the first ring at the starting point and extends the first cord member in a direction along the plane of the backboard to the fourth ring. Holding the fourth ring, the user extends the remaining portion of the first cord member to the second ring, which will intersect the jump circle on one side. Holding the cord member to the playing surface between the fourth and second rings, the user marks a line along the side of the cord member using the marking device. The other side of the key is laid out the same way, by having the first cord member between the first and fourth rings go in the opposite direction. The free throw line is drawn by placing a length of a cord member between the points where the sides of the key intersect the jump circle and then, using the marking device, drawing a line along the cord member.

One alternative embodiment of the present invention is the elimination of the fourth ring. This modification will require the third ring to be placed at the starting point when drawing the sides of the key. Another alternative embodiment is to add a four foot length of cord and an additional ring to the first or third rings. The purpose of the additional cord and ring would be to assist the user in positioning the regulation end line and to facilitate the user designating the side lines and mid-court line.

Accordingly, the primary objective of the present invention is to provide an easily transportable and simple to use device and method for quickly laying out the various features of a basketball court.

It is also an important objective of the present invention to provide a relatively inexpensive device for quickly and correctly laying out various features of a basketball court.

It is also an important objective of the present invention to provide a basketball court layout device that has one or more flexible, inextensible cord-like members and a plurality of ring-like members connected to the cord-like members at positions that facilitate the laying out of the various features of basketball court.

It is also an objective of the present invention to provide a basketball layout device which utilizes a pivot member and a marking device to layout the various features of a basketball court.

BRIEF DESCRIPTION OF THE DRAWINGS

In the drawings which illustrate the best modes presently contemplated for carrying out the present invention.

DETAILED DESCRIPTION OF THE PREFERRED EMBODIMENT

Figure 1:
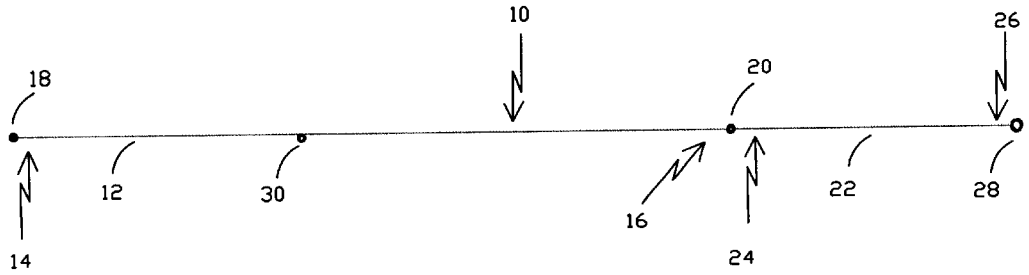
FIG. 1 illustrates the preferred embodiment of the present invention.

With reference to the figures where like elements have been given like numerical designations to facilitate the reader's understanding of the present invention, the preferred embodiment of the present invention is set forth below. The basketball court layout device of the present invention (shown in FIG. 1), designated generally as 10, includes a first elongated member 12 having first end 14 and second end 16. Connected at first end 14 is first ring-like member 18 and connected at second end 16 is second ring-like member 20. Second elongated member 22, having first end 24 and second end 26, is connected to second ring-like member 20 at first end 24. Connected at second end 26 of second elongated member 22 is third ring-like member 28. The preferred embodiment includes fourth ring-like member 30 connected on one side to first elongated member 12 between first ring-like member 18 and second ring-like member 20. In the preferred embodiment, the elongated members should be slidably connected to the ring-like members to facilitate pivoting of the elongated members about a stationary ring-like member. The elongated members can connect directly to the ring-like members (i.e., through the use of knots) or they can connect to an intermediate device (i.e., a small ring that encircles the ring-like member) or any other connecting method commonly known.

First elongated member 12 and second elongated member 22 can be a cord-like material, such as cord, rope, wire or the like. The first 12 and second 22 elongated members should be flexible or collapsible to allow the device 10 to be folded or rolled up for transport to the location where the basketball court layout is desired. Because the distances between the various ring-like members is important, the first 12 and second 22 elongated members should be substantially inextensible so that the dimensions of the court will be the same each time the device 10 is used. The inventor has found that rubber or plastic coated cable having a diameter of five-sixteenths of an inch works well, although other cord-like materials of varying diameters will work equally as well.

The ring-like members 18, 20, 28 and 30 can comprise any suitable shape and size. The inventor has found that circular rings having an inside diameter of one to two inches and an outer diameter of one-and-one-half to two-and-one-half inches works well. The inside diameter of the ring-like members, particularly the third ring-like member (which is used to draw various curved lines), can be sized to fit available line marking materials. As with the elongated members, other configurations for the ring-like members will work equally as well. Each of the ring-like members should be colored, configured or in some other fashion be distinguishable from the other ring-like members to assist the user in quickly and easily laying out the features of the basketball court.

Figure 2:
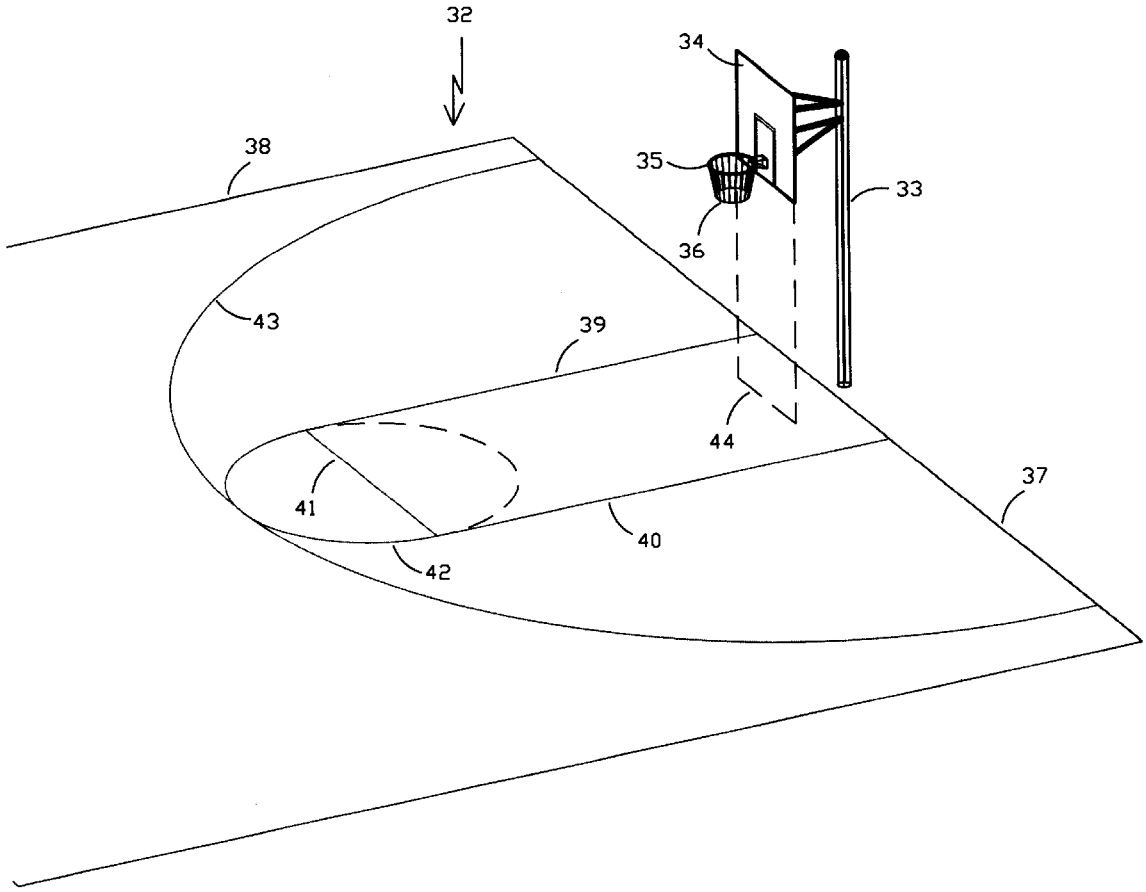
FIG. 2 illustrates the layout of a typical basketball court.

The distances between the ring-like members should be set for certain size basketball courts. For example, a regulation court, as shown in FIG. 2, has specific dimensional relationships between the various features. To obtain the proper court layout, the distance between the center of first ring-like member 18 and second ring-like member 20 should be fifteen feet, the distance between the center of second ring-like member 20 and the center of third ring-like member 28 should be six feet and the distance between the center of first ring-like member 18 and the center of fourth ring-like member 30 should be six feet. Other, non-regulation court layouts will require modifications to the above distances.

FIG. 2 illustrates a typical basketball court layout, designated generally as 32. The basketball pole 33 is located outside the playing area of the court and is connected to backboard 34. The rim 35, which holds net 36, is attached to the playing face of backboard 34. The playing area of the basketball court is enclosed by the end line 37 and side lines 38. Below the net is the key area, which is bounded by key sides 39 and 40 and by the free throw line 41. Jump circle 42 is located at the top of the key area. Three point line 43 is a semi-circle arch that extends from end line 37 on one side of pole 33 to end line 37 on the other side.

Many unofficial basketball court sites, such as those found at parks, schools and church areas, do not have sufficient room for a regulation size court. Most professional and college courts utilize a hanger assembly that allows backboard 34 to hang from the ceiling, thereby avoiding use of pole 33. Areas that have poles, including driveways and street use of portable basketball goals, do not have room for end line 37 to be four feet behind the plane along the face of backboard 34. Many of these "unofficial" sites utilize a base line 44 as the end line. Base line 44 is at the intersection of the playing surface with the plane along the face of backboard 34. The preferred embodiment of the present invention provides for a court layout that utilizes the base line 44 as the end line.

Figure 3:
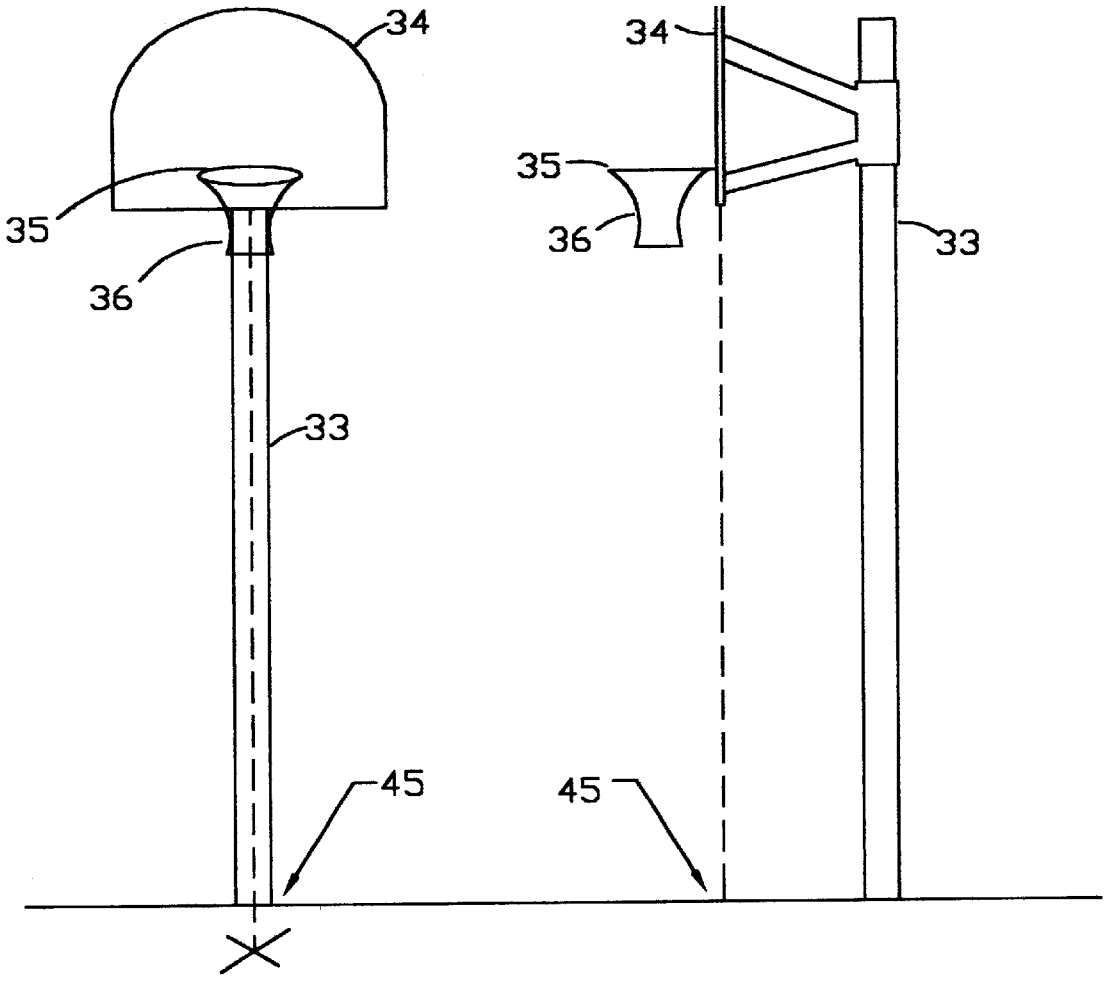
FIG. 3 illustrates the location of the starting point in relation to a conventional basketball pole, backboard and net.
Figure 4:
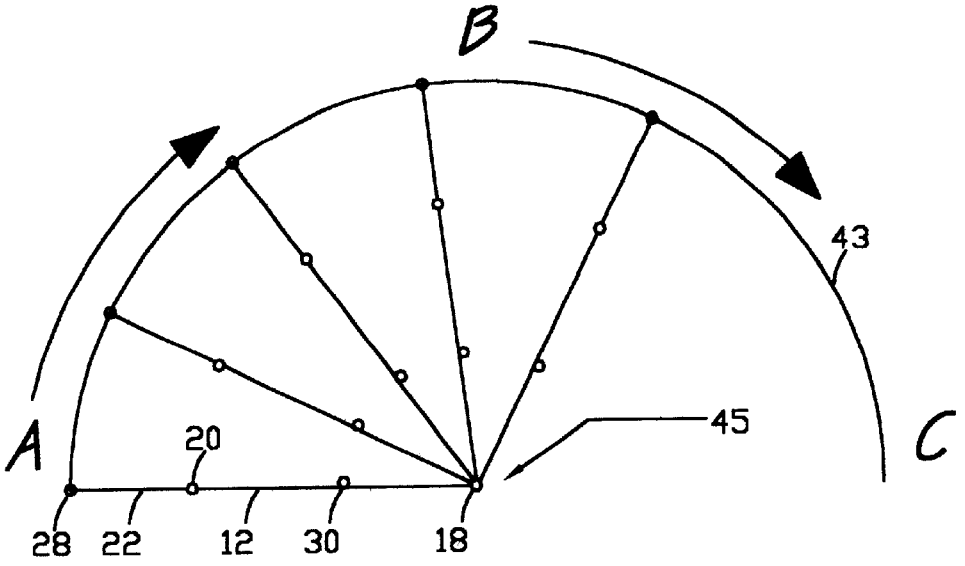
FIG. 4 illustrates the laying out of the three point line using the device of the present invention.

In use, the user first finds starting point 45, which is located directly below the center of backboard 34, as shown in FIG. 3. Next, the user places the center of first ring-like member 18 on starting point 45 and a marking tool (not shown), such as a piece of chalk, in third ring-like member 28. The user then fully extends first elongated member 12 and second elongated member 22 in the direction of the plane along the face of backboard 34, which is base line 44 by pulling on third ring-like member 28. Keeping the first 12 and second 22 elongated members in tension and the marking tool on the playing surface, the user draws a semi-circular arch from 44 base line on one side of pole 33 to base line 44 on the other side, shown as the A to B to C motion in FIG. 4. This creates three point line 43.

Figure 5:
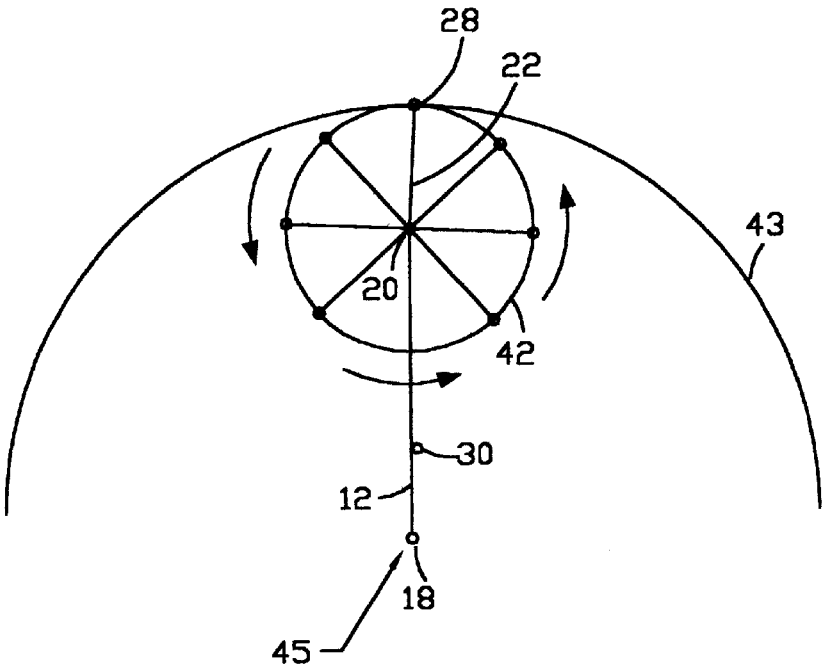
FIG. 5 illustrates the laying out of the jump circle using the device of the present invention.

The user can then create the jump circle 42, as shown in FIG. 5, by holding first ring-like member 18 at starting point 45 and extending first 12 and second 22 elongated members to the top of three point line 43, a point perpendicular to and furthest from the face of backboard 34. In this manner, second ring-like member 20 will be the center of jump circle 42. Holding second ring-like member 20 in place and with the chalk in third ring-like member 28, the user pivots member 28 around member 20, as shown in the motion of the arrows in FIG. 5.

Figure 6:
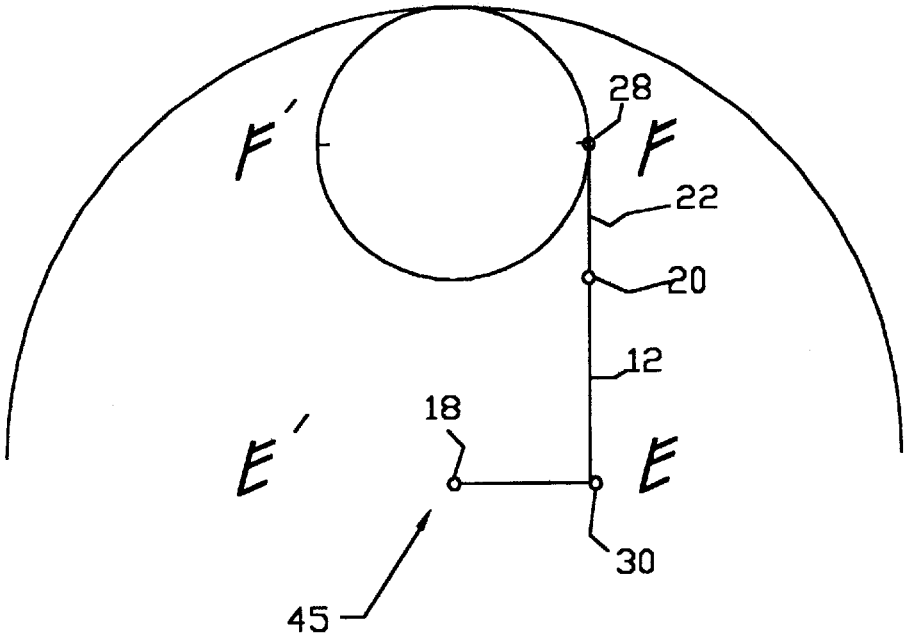
FIG. 6 illustrates the laying out of one side of the key using the device of the present invention.
Figure 7:
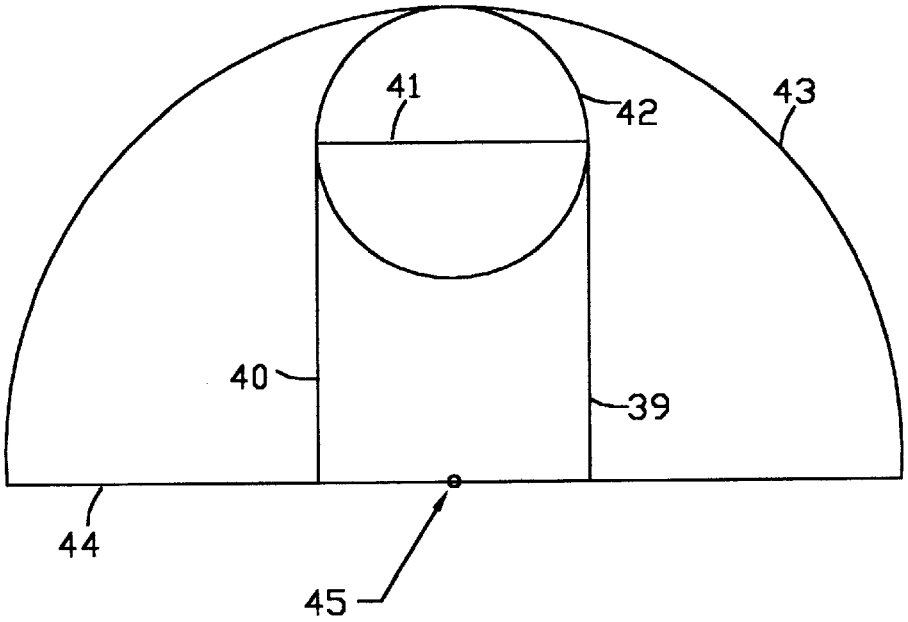
FIG. 7 illustrates the complete key, three point line and base line.

To create the key, the user holds first ring-like member 18 at starting point 45 and extends first elongated member 12 along the plane of backboard 34 (the base line 44) to fourth ring-like member 30 (shown as point E on FIG. 6). Holding member 30 at point E, the user fully extends the remaining portion of first elongated member 12 and the entire length of second elongated member 22 in a direction perpendicular to the plane of backboard 34 until third ring-like member 28 is at point F. Holding members 28 and 30 in place and using the elongated members 12 and 22 as a guide, the user draws a line between points E and F, creating one side of the key (shown as 39 in FIG. 2). The other side of the key (shown as 40 in FIG. 2) is created by performing the same steps in the opposite direction, thereby connecting points E' and F', as shown in FIG. 6. Free throw line 41, shown in place in FIG. 7, is created by placing a portion of either first 12 or second 22 elongated members on points F and F', thereby interconnecting points F and F', and drawing a line along the elongated member that is parallel to the plane of the face of backboard 34. If desired, the user of device 10 can place an end line along base line 44, as shown in FIG. 7, by drawing a line along the stretched out first 12 and second 22 elongated members from points A to C.

The method of laying out a basketball court set forth above is the preferred method. However, the order in which the various basketball court features are laid out can be changed (i.e., the key can be laid out first, then the jump circle and then the three point line, or any other variation), without affecting the ease or ability to lay out those features. In addition, depending on the user's preference, various features of the basketball court layout can be eliminated without affecting the ability to lay out the desired portions of a regulation basketball court. For instance, a player may only want to practice with the key and free throw line and could, therefore, not lay out the three point line and jump circle. Likewise, a player desiring to practice three point shots only, can just lay out the three point line.

The method of creating a layout of a basketball court described above typically only takes a few minutes to complete. If the ring-like members are distinguishable from each other, the instructions for completing the process set forth above can be significantly simplified. The user only has to know where to put which ring-like member. For instance, if color is used to distinguish the ring-like members, the instructions merely has to tell the user to place a certain colored ring at a certain place or to put the chalk in a certain colored ring to draw a curve.

One alternative embodiment of the device 10 of the present invention, not illustrated, eliminates fourth ring-like member 30, which in the preferred embodiment is placed six feet from first ring-like member 18. With fourth ring-like member 30 eliminated, the user would create the sides of the key by holding third ring-like member at starting point 45 and extending second elongated member 22 to point E on FIG. 6. Pulling on first ring-like member 18, first elongated member 12 would be extended between points E and F and a line would be drawn along the side of first elongated member 12 to create key side 39. The same procedure would be repeated to create key side 40 between points E' and F' on the opposite side.

Another alternative embodiment, also not illustrated, would include an additional elongated member connected at one end to first ring-like member 18 or third ring-like member 28 to assist the user of device 10 to locate the end 37 and side 38 lines. For a regulation sized court, the additional elongated member would be four feet long. An additional ring-like member could be connected to the free end of the additional elongated member to facilitate locating the lines associated with end 37 and side 38 lines.

Figure 8:
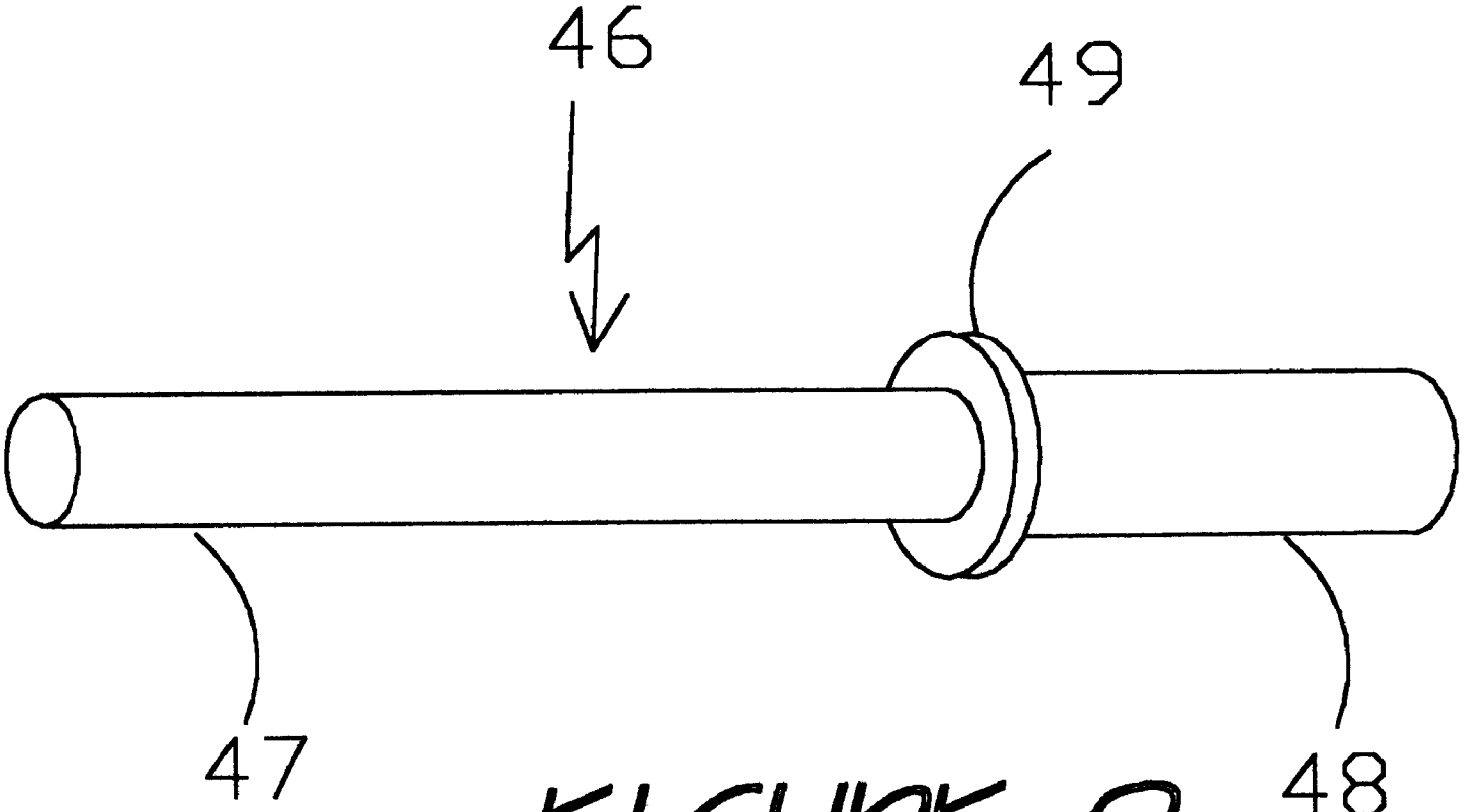
FIG. 8 illustrates one embodiment of a pivot member to be used with the device of the present invention.

If desired, device 10 can be provided with a pivot tool for assisting the user in drawing the curved portions of the court layout. One example of such a tool is pivot member 46, shown in FIG. 8. Pivot member 46 is provided with a first end 47 and second end 48. The first 47 and second 48 ends can be of different sizes to fit inside the ring-like members and to provide a good grip. A hand rest 49 between the ends of pivot member 46 can be provided to help the user hold pivot member 46 in place. The different size ends can also fit into different sized ring-like members. the elongated members to the ring-like members. Alternatively, the elongated member can comprise an inflexible, yet collapsible, material, such as wood or metal, that is unfolded when the user desires to layout a basketball court.

While there is shown and described herein certain specific alternative forms of the invention, it will be readily apparent to those skilled in the art that the invention is not so limited, but is susceptible to various modifications and rearrangements in design and materials without departing from the spirit and scope of the invention. In particular, it should be noted that the present invention is subject to modification with regard to the dimensional relationships set forth herein and modifications in assembly, materials, size, shape and use.

What is claimed is:

1. A basketball court layout device, comprising:

a first elongated member having a first end and a second end, said first elongated member being flexible and substantially inextensible;

a first ring slidably connected to said first end of said first elongated member;

a second ring slidably connected to said second end of said first elongated member;

a second elongated member having a first end and a second end, said first end of said second elongated member slidably connected to said second ring, said second elongated member being flexible and substantially inextensible; and a third ring slidably connected to said second end of said second elongated member.

2. The basketball court layout device according to claim 1, wherein each of said first elongated member and said second elongated member comprise a length of cord-like material.

3. The basketball court layout device according to claim 1 further comprising pivot means for pivoting said first and second elongated members around said first, second and third rings.

4. The basketball court layout device according to claim 1 further comprising marking means for drawing the lines and curves which makeup the basketball court layout, said marking means sized to fit in said third ring.

5. The basketball court layout device according to claim 1, wherein each of said first, second and third rings are a different color.

6. The basketball court layout device according to claim 1, wherein the distance between said first ring and said second ring is fifteen feet and the distance between said second ring and said third ring is six feet.

7. The basketball court layout device according to claim 1 further comprising a fourth ring connected to said first elongated member between said first ring and said second ring .

8. The basketball court layout device according to claim 7, wherein the distance between said first ring and said fourth ring is six feet.

9. The basketball court layout device according to claim 8, wherein the distance between said first ring and said second ring is fifteen feet and the distance between said second ring and said third ring is six feet.

10. The basketball court layout device according to claim 1 further comprising a third elongated member and a fifth ring, said third elongated member having a first end and a second end, said first end of said third elongated member connected to said third ring, said fifth ring connected to said second end of said third elongated member.

11. The basketball court layout device according to claim 10, wherein the distance between said third ring and said fifth ring is four feet said third elongated member is flexible and substantially inextensible.

12. A basketball court layout device, comprising:

a first cord-like member having a first end and a second end, said first elongated member being flexible and substantially inextensible;

a first ring slidably connected to said first end of said first cord-like member, said first ring having first identifying means for identifying said first ring;

a second ring slidably connected to said second end of said first cord-like member, said second ring having second identifying means for identifying said second ring, the distance between said first ring and said second ring being fifteen feet;

a second cord-like member having a first end and a second end, said first end of said second cord-like member slidably connected to said second ring, said second cord-like member being flexible and substantially inextensible;

a third ring slidably connected to said second end of said second cord-like member, said third ring having third identifying means for identifying said third ring, the distance between said second ring and said third ring being six feet; and a fourth ring connected to said first cord-like member between said first ring and said second ring, said fourth ring having fourth identifying means for identifying said fourth ring member, the distance between said first ring and said fourth ring being six feet.

13. The basketball court layout device according to claim 12 further comprising pivot means for pivoting said first and second elongated members around said first, second and third rings.

14. The basketball court layout device according to claim 12 further comprising a third elongated member and a fifth ring, said third elongated member being flexible and substantially inextensible and having a first end and a second end, said first end of said third elongated member connected to said third ring, said fifth ring connected to said second end of said third elongated member.

15. The basketball court layout device according to claim 14, wherein the distance between said third ring and said fifth ring is four feet.

16. A method for laying out selected features of a basketball court in relation to the location of the backboard, comprising the steps of:

a. locating a starting point directly below a center of the backboard;

b. holding a first ring-like member at said starting point, said first ring-like member being attached to a first end of a first cord-like member;

c. placing a marking tool in a third ring-like member, said third-ring like member being attached to a second end of a second cord-like member, said second cord-like member being attached at a first end of said second cord-like member to a second ring-like member, said second ring-like member being further attached to a second end of said first cord-like member;

d. drawing a jump circle by extending said first and second cord-like members in a direction perpendicular to the backboard, locating the center of said jump circle at said second ring-like member, holding said second ring-like member in place and pivoting said marking tool completely around said second ring-like member;

e. drawing a first key side by placing said third ring-like member on said starting point, extending said second cord-like member along a plane of the blackboard to said second ring-like member, holding said second ring-like member in place while extending said first cord-like member perpendicular to the plane of the backboard toward said jump circle, and marking said first key side along the length of said first cord-like member between said first and second ring-like members with said marking tool;

f. drawing a second key side by placing said third ring-like member on said starting point, extending said second cord-like member along a plane of the blackboard opposite said first key side to said second ring-like member, holding said second ring-like member in place while extending said first cord-like member perpendicular to the plane of the backboard toward said jump circle, and marking said second key side along the length of said first cord-like member between said first and second ring-like members with said marking tool; and g. drawing a free throw line by placing one of said first and second cord-like members between the intersecting point of said jump circle with said first key line and the intersecting point of said jump circle with said second key line and marking said free throw line along one of said first and second cord-like members with said marking tool.

17. The method for laying out selected features of a basketball court of claim 16 further comprising the step of drawing a three-point line by holding said first ring-like member at said starting point, placing said marking tool in said third ring-like member, extending said first and second cord-like members to the full length of said first and second cord-like members along the plane of the backboard from said starting point, and holding tension on said first and second cord-like members while pivoting said marking tool around said first ring-like member.

18. The method for laying out selected features of a basketball court of claim 16 further comprising the step of drawing a base line by extending said first and second cord-like members along the plane of the backboard and marking said base line along said first and second cord-like members with said marking tool.

19. A method for laying out selected features of a basketball court in relation to the location of the backboard, comprising the steps of:

a. locating a starting point directly below a center of the backboard;

b. holding a first ring-like member at said starting point, said first ring-like member being attached to a first end of a first cord-like member;

c. placing a marking tool in a third ring-like member, said third-ring like member being attached to a second end of a second cord-like member, said second cord-like member being attached at a first end of said second cord-like member to a second ring-like member, said second ring-like member being further attached to a second end of said first cord-like member, a fourth ring-like member being attached to said first cord-like member between said first and second ring-like members;

d. drawing a jump circle by extending said first and second cord-like members in a direction perpendicular to the backboard, locating the center of said jump circle at said second ring-like member, holding said second ring-like member in place and pivoting said marking tool completely around said second ring-like member;

e. drawing a first key side by placing said first ring-like member on said starting point, extending said first cord-like member along a plane of the blackboard to said fourth ring-like member, holding said fourth ring-like member in place while extending said first cord-like member and said second cord-like member perpendicular to the plane of the backboard toward said jump circle, and marking said first key side along the length of said first and second cord-like members between said fourth and third ring-like members with said marking tool;

f. drawing a second key side by placing said first ring-like member on said starting point, extending said first cord-like member along a plane of the blackboard opposite said first key side to said fourth ring-like member, holding said fourth ring-like member in place while extending said first cord-like member and said second cord-like member perpendicular to the plane of the backboard toward said jump circle, and marking said second key side along the length of said first and second cord-like members between said fourth and third ring-like members with said marking tool; and g. drawing a free throw line by placing one of said first and second cord-like members between the intersecting point of said jump circle with said first key line and the intersecting point of said jump circle with said second key line and marking said free throw line along one of said first and second cord-like members with said marking tool.

* * * * *